United States Patent [19]

Sosinski

[11] Patent Number: 4,932,179

[45] Date of Patent: Jun. 12, 1990

[54] ABANDONMENT PLUG FOR CONCRETE FLOORS

[75] Inventor: Charles W. Sosinski, Linden, N.J.

[73] Assignee: Thomas & Betts Corporation, Bridgewater, N.J.

[21] Appl. No.: 351,691

[22] Filed: May 12, 1989

[51] Int. Cl.[5] ..... E04C 2/00

[52] U.S. Cl. ..... 52/232; 52/220; 220/88 R; 220/234

[58] Field of Search ..... 52/220, 232, 221; 220/88 R, 234, 235; 174/48

[56] References Cited

U.S. PATENT DOCUMENTS

| | | | |
|---|---|---|---|
| 3,255,559 | 6/1966 | Gaeth et al. | 52/232 |
| 4,259,542 | 3/1981 | Tehan et al. | 174/48 |
| 4,270,318 | 6/1981 | Carroll et al. | 52/232 X |
| 4,432,465 | 2/1984 | Wuertz | 52/232 X |
| 4,572,923 | 2/1986 | Castellani et al. | 174/48 |

*Primary Examiner*—David A. Scherbel
*Assistant Examiner*—Linda J. Hoffert
*Attorney, Agent, or Firm*—Robert M. Rodrick; Salvatore J. Abbruzzese

[57] ABSTRACT

An abandonment plug assembly for limiting heat and fire passage through an opening formed through a floor, comprises a cover for disposition atop the floor and configured to extend beyond the opening and engage the floor, first and second cup members dependant from the cover and mutually displaceable toward one another to force a substance disposed therebetween into contiguity with the sidewall bounding the opening, an actuator for effecting the displacement of the first and second cup members and intumescent discs depending from the second cup member.

13 Claims, 3 Drawing Sheets

ABANDONMENT PLUG FOR CONCRETE FLOORS

FIELD OF THE INVENTION

This invention relates to apparatus and method for effectively abandoning electrical conduit openings formed in concrete and like building floors and pertains more particularly to a plug assembly for such purpose.

BACKGROUND OF THE INVENTION

There has been extensive prior art activity in the pursuit of averting the use of on-floor conduits for conveying electrical power and telephone or communication lines to floor locations which were not within the original architectural and electrical planning of a facility, such as a multi-floor concrete building. Such on-floor conduits are in the first place aesthetically unpleasant and secondly can give rise to personnel danger, such as by tripping over the same.

While the art has averted these problems in the introduction of flat undercarpet cable installations, the problem remains extant in the use of the conventional discrete wiring systems in place in general in existing buildings and for currently-planned facilities in which the undercarpet approach is not elected.

In the conventional discrete installations, the problem under discussion has been addressed by drilling a passage through the concrete floor and conducting power and/or communication signals from an under floor to the floor in which a new power and/or communication signal outlet is desired. Electrical safety codes have place two sanctions on such activity. Firstly, it is essential that the installed transition apparatus not function as a chimney or fire-advancing flue in the event of fire occurrence on the lower floor. Secondly, it is imperative that the transition apparatus not function as a conductive heat channel between floors. The industry has largely met these requirements through the use of intumescent material in the transition apparatus, such material expanding under fire conditions against the concrete circumscribing the passage to effectively block the pre-existing flue which may have been present in the passage. Further, the art has reached structures which have conductive heat blocking members, i.e., synthetic spacers, disposed axially between and separating conductive heat communication between heat conductive members of the apparatus.

Occasions arise where installed such apparatus becomes superseded by new power/communication facility layout needs. Here, one abandons prior inter-floor transition apparatus and looks to drill new passages through the concrete floor and to install new transition apparatus. Typically, the art has left the prior transition apparatus in place, with its satisfaction of the two industry requirements, and has installed a so-called "abandonment plate" or the like over the in-place apparatus. This practice has the adversity of the leaving of a relatively expensive and otherwise usable component in place with the requirement for new transition apparatus to be provided for the new installation.

SUMMARY OF THE INVENTION

It is a primary object of the present invention to provide greater economy and efficiency in abandoning floor-to-floor transition apparatus.

It is a more particular object of the invention to provide an effective alternate apparatus and practice to that heretofore known in addressing the problem at hand.

A specific object of the invention is the provision of an alternate to the continued use of the previously installed transition apparatus in abandonment situations, which alternate is cost effective and permits reuse of the previously installed transition apparatus.

In the effective attainment of the foregoing and other objects, the invention provides an abandonment plug assembly, fully replacing the previously installed transition apparatus and permitting independent reuse thereof elsewhere. The assembly of the invention includes a cover for closing the pre-exiting passage through the floors and cup members dependant from the cover and mutually axially displaceable toward one another to dispose a substance confined therebetween into contiguity with the passage wall, intumescent material being dependent from one of the cup members to be displaced into contiguity with the passage wall in the event of fire-related heat conditions in the underfloor.

In a particularly preferred embodiment, the invention provides an abandonment plug configured as above described wherein the intumescent material is in the form of first through third intumescent discs disposed below the lower of the cup members, the first and second of such discs being jointly secured to the lower cup member by a first assembly joinder element and the second and third of such discs being jointly secured to one another by a second assembly member, whereby the first assembly joinder element is isolated to an extent from fire-induced heat in the passage by the third disc.

The foregoing and other objects and features of the invention will be further understood from the following detailed description of preferred embodiments thereof and from the drawings wherein like reference numerals identify like components and parts throughout.

DETAILED DESCRIPTION OF PREFERRED EMBODIMENTS AND PRACTICES

Figure 1:
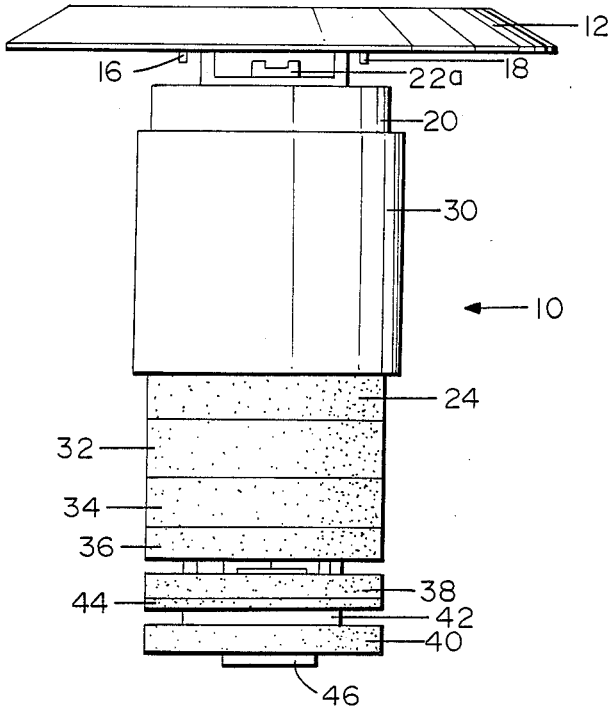
FIG. 1 is a front elevational view of an abandonment plug assembly in accordance with the invention.
Figure 2:
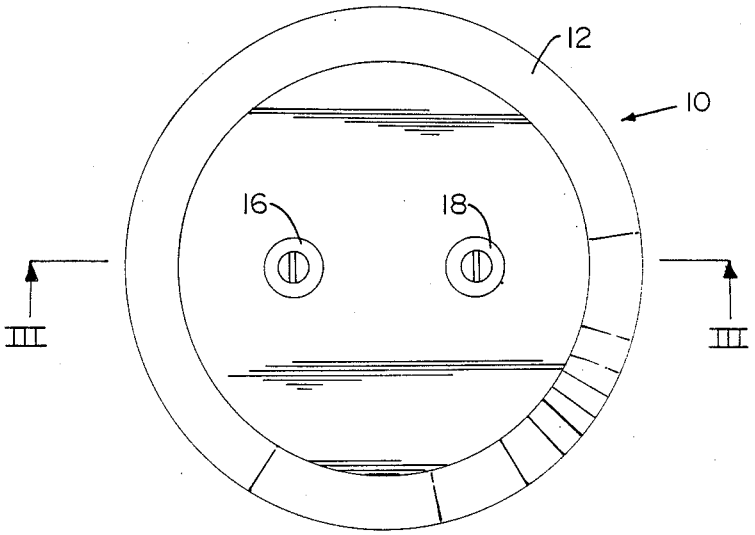
FIG. 2 is a top plan view of the FIG. 1 abandonment plug assembly.
Figure 3:
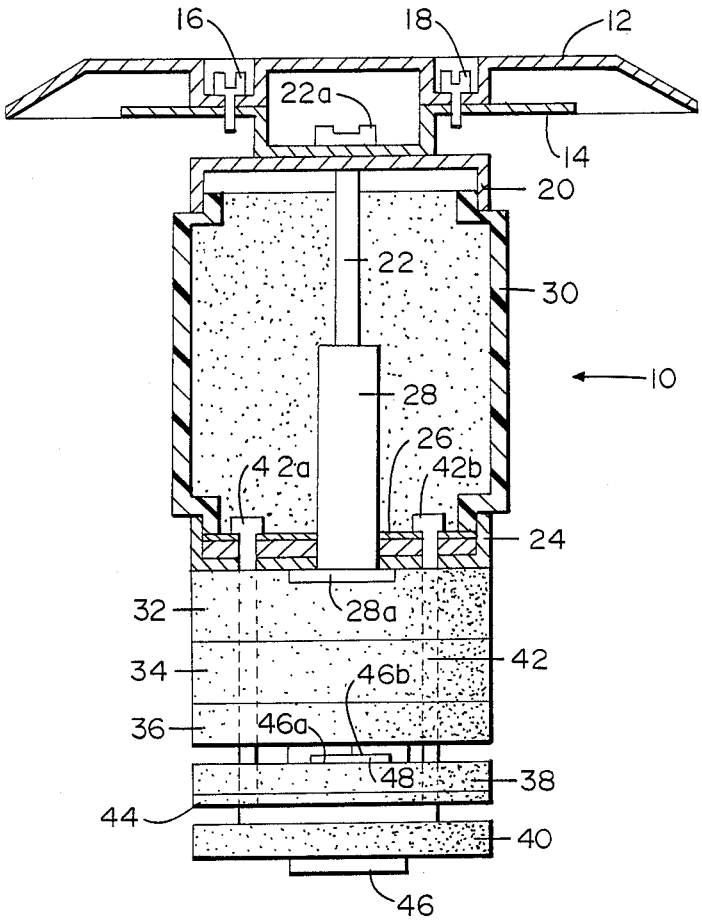
FIG. 3 is a partial sectional view as would be seen from plane III—III of FIG. 2, with sectioning omitted for convenience of illustration.

Referring to FIGS. 1–4, abandonment plug assembly 10 includes cover 12 and bracket 14 releasably secured to one another by fasteners 16 and 18. Upper cup 20 is affixed to the underside of bracket 14 and defines therewith a central opening for passage of installing screw 22, which is exteriorly threaded and includes head **22*a* bearing on the upper surface of bracket 14**.

Lower cup 24 has washer 26 seated therein and forming therewith a central opening for passage of positive stop stud 28 whose head **28*a* bears on the undersurface of cup 24. Containment film 30 is secured to the interior sidewalls of cups 20 and 24** and contains a compressible material, such as intumescent putty.

Downwardly of cup 24, assembly 10 includes a first group of intumescent discs 32, 34 and 36 and further intumescent discs 38 and 40. Assembly wire 42 bears on the undersurface of washer 44 and extends through openings formed through washer 44, discs 32, 34, 36 and 38, cup 24 and washer 26, wire 42 being beaded or otherwise deformed atop washer 26 at wire ends 42*a* and 42*b*. Assembly clip 46 passes through central openings in discs 38 and 40 and washer 44 and may be in the form of a cotter pin whose head bears on the undersurface of disc 40 and whose wings 46*a* and 46*b* bear on washer 48 disposed on the upper surface of disc 38.

Figure 4:
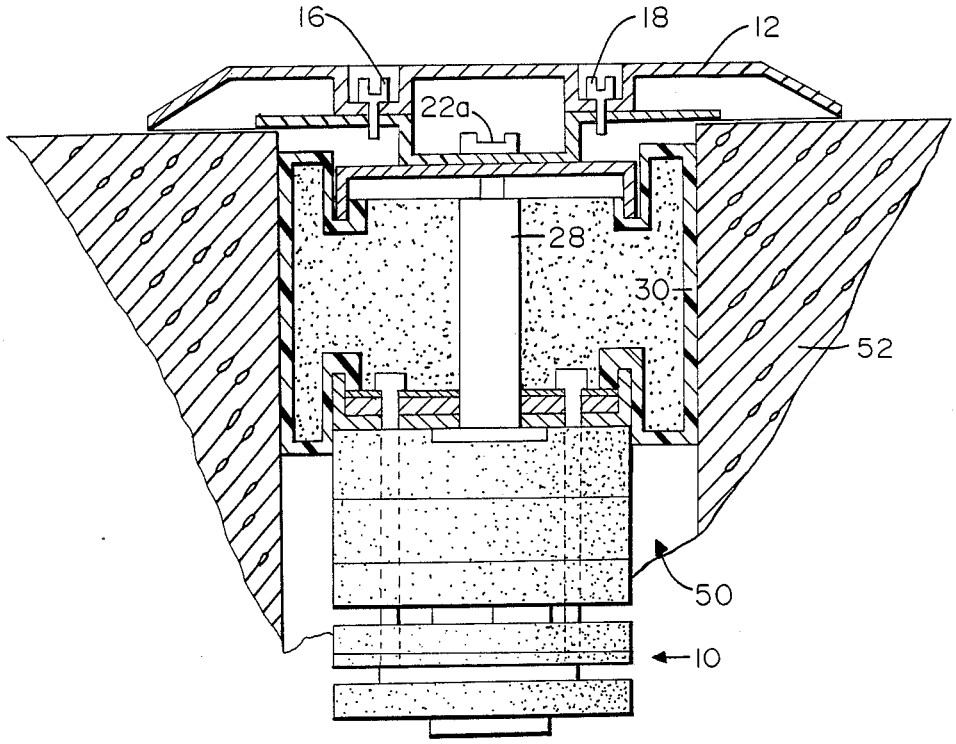
FIG. 4 is a repetitive showing of FIG. 3 with the plug assembly shown in activated state for the closing of a concrete interfloor passage.

Referring now to FIG. 4, assembly 10 is shown in operated condition, installed in opening 50 in concrete floor 52. In achieving such installed state, cover 12 is removed from bracket 14 and the assembly is inserted into opening 50 until bracket 14 rests on floor 52. Installation screw 22 is now turned until stop 28 abuts on the undersurface of cup 20. In the course of turning of screw 22, cup 24 is drawn upwardly toward cup 20, compressing the intumescent putty in film 30 against the film and forcing the film into sealing engagement with the sidewall of opening 50 fully perimetrically thereof. Cover 12 is then secured to bracket 14 and the cover tapered outer periphery engages floor 52 as illustrated.

In the event of fire beneath floor 52, the initial heat, smoke and toxic gases are prevented from passing through the plugged opening by the previously expanded putty in film 30. As the temperature rises, the lower intumescent discs expand radially, and will seal against the sidewall of opening 50. The putty in film 30 will also expand, although to a lesser degree, due to its inherent intumescent characteristics, resulting in a tighter fit within opening 50. The continuing rising temperature will cause the lower intumescent discs to turn to a char which acts as an insulating barrier to the heat. Over a long time span, the char may eventually fall away. However, the expanded putty in film 30 will continue to restrict the passage of fire and heat.

As will also be seen, assembly 10 is configured to minimize conductive heat transfer therethrough, providing thermal breaks between its heat conductive metal components. Heat conduction from washer 44 through assembly wire 42 to washer 26 and cup 24 is limited by both the interior disposition of wire 42 and the buffering of the wire and washer 44 by disc 40. Further, while assembly clip 46 is exposed below assembly 10, heat transfer therethrough is limited its upper confronting relation to disc 36. Evidently, there is no direct heat conductive metal path through the assembly. Further, the integrity of the apparatus is maintained as char may fall away, based on the interlocking design of the metal components.

Of further assistance to avoidance of heat transfer is the choice of cover diameter on the order of twice the diameter of the remainder of the assembly, allowing the cover to also function as an effective heat radiator. Thus, the unexposed surface of the cover maintains a temperature approximately equivalent to the unexposed surface of the floor in which the assembly is installed.

Various changes in configuration and modifications in practice may be introduced in the foregoing preferred embodiment without departing from the invention. For example, while cup 20 is affixed to bracket 14 in the illustrated embodiment, the invention contemplates threaded fasteners extending through cup 20 into threaded openings in fastener 14, whereby the depthwise disposition of film 30 in the floor opening may be selected as desired. Further, the installation screw 22 may be modified to comprise a two part telescopic screw cooperative with the positive stop stud 28. Accordingly, it is to be understood that the described and depicted embodiment is intended in a descriptive and not in a limiting sense. The true spirit and scope of the invention are set forth in the following claims.

What is claimed is:

1. An abandonment plug assembly for limiting heat and fire passage through an opening formed through a floor, comprising:

a cover for disposition atop the floor and configured to extend beyond said opening and engage the floor;

first and second cup members dependent from the cover and mutually displaceable toward one another;

intumescent putty supported between said cup members, said putty being compressible into sealing engagement with a perimeter of a sidewall bounding said opening;

actuator means for effecting said displacement of said first and second cup members; and intumescent disc means depending from said second cup member;

said intumescent putty being expandable upon exposure to heat to expand against said sidewall perimeter to restrict the passage of heat therethrough.

2. The invention claimed in claim 1 further including a film extending between said first and second cup members and containing said putty.

3. The invention claimed in claim 1 wherein said actuator means comprises an installation screw abutting said first cup member and extending therethrough and an interiorly threaded stud abutting said second cup member and extending therethough and in engagement with said installation screw.

4. The invention claimed in claim 3 further including a film extending between said first and second cup members and containing said putty, said screw and said stud being disposed in part within said putty.

5. The invention claimed in claim 3 wherein operation of said actuator means in displacing said cup members toward one another is limited by said stud engaging said first cup member, thereby precluding further mutual displacement of said cup members.

6. The invention claimed in claim 1 wherein said intumescent disc means comprises first, second and third disc means, said assembly further including a first joinder member securing said first and second disc means to said second cup member and a second joinder member securing said third disc means to said second disc means.

7. The invention claimed in claim 6 wherein said first joinder member extends through said first and second disc means at radially interior locations therein and has a part thereof disposed between said second and third disc means.

8. The invention claimed in claim 7 wherein said second joinder member extends centrally through said second and third disc means and has a part thereof disposed between said first and second disc means.

9. The invention claimed in claim 6 wherein said first disc comprises a plurality of individual intumescent discs.

10. The invention claimed in claim 1 further including bracket means secured to said first cup member, said cover being releasably secured to said bracket means.

11. The invention claimed in claim 10 wherein said bracket means is fixedly secured to said first cup member.

12. The invention claimed in claim 10 wherein said cover includes a tapered peripheral portion.

13. The invention claimed in claim 10 wherein said cover has a diameter exceeding that of said first cup member.

* * * * *

UNITED STATES PATENT AND TRADEMARK OFFICE

CERTIFICATE OF CORRECTION

PATENT NO. : 4,932,179

DATED : June 12, 1990

INVENTOR(S) : Charles W. Sosinski

It is certified that error appears in the above-identified patent and that said Letters Patent is hereby corrected as shown below:

ON TITLE PAGE:

The illustrarive figure on the title page should be deleted to appear as per attached title page.

Signed and Sealed this

Eighth Day of October, 1991

*Attest:*

HARRY F. MANBECK, JR.

*Attesting Officer*

*Commissioner of Patents and Trademarks*

United States Patent [19]

Sosinski

[11] Patent Number: 4,932,179

[45] Date of Patent: Jun. 12, 1990

[54] ABANDONMENT PLUG FOR CONCRETE FLOORS

[75] Inventor: Charles W. Sosinski, Linden, N.J.

[73] Assignee: Thomas & Betts Corporation, Bridgewater, N.J.

[21] Appl. No.: 351,691

[22] Filed: May 12, 1989

[51] Int. Cl.[5] ..... E04C 2/00

[52] U.S. Cl. ..... 52/232; 52/220; 220/88 R; 220/234

[58] Field of Search ..... 52/220, 232, 221; 220/88 R, 234, 235; 174/48

[56] References Cited

U.S. PATENT DOCUMENTS

| | | | |
|---|---|---|---|
| 3,255,559 | 6/1966 | Gaeth et al. | 52/232 |
| 4,259,542 | 3/1981 | Tehan et al. | 174/48 |
| 4,270,318 | 6/1981 | Carroll et al. | 52/232 X |
| 4,432,465 | 2/1984 | Wuertz | 52/232 X |
| 4,572,923 | 2/1986 | Castellani et al. | 174/48 |

*Primary Examiner*—David A. Scherbel
*Assistant Examiner*—Linda J. Hoffert
*Attorney, Agent, or Firm*—Robert M. Rodrick; Salvatore J. Abbruzzese

[57] ABSTRACT

An abandonment plug assembly for limiting heat and fire passage through an opening formed through a floor, comprises a cover for disposition atop the floor and configured to extend beyond the opening and engage the floor, first and second cup members dependant from the cover and mutually displaceable toward one another to force a substance disposed therebetween into contiguity with the sidewall bounding the opening, an actuator for effecting the displacement of the first and second cup members and intumescent discs depending from the second cup member.

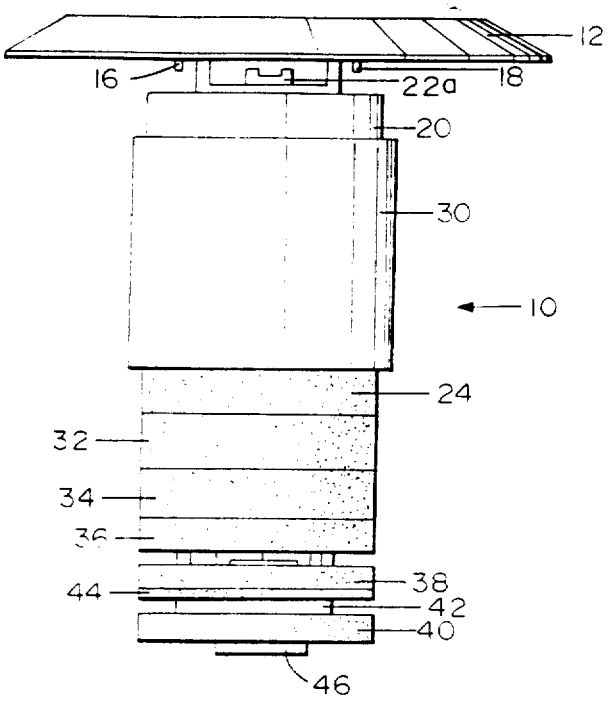

13 Claims, 3 Drawing Sheets